US010698344B2

(12) United States Patent
Taniguchi et al.

(10) Patent No.: US 10,698,344 B2
(45) Date of Patent: Jun. 30, 2020

(54) MOLDING DEVICE, METAL MOLD, METHOD OF MANUFACTURING MAGNET ROLL AND METHOD OF MAGNETIZING MAGNET ROLL

(71) Applicant: Hitachi Metals, Ltd., Tokyo (JP)

(72) Inventors: Osamu Taniguchi, Takasaki (JP); Masahiko Orimo, Takasaki (JP)

(73) Assignee: Hitachi Metals, Ltd., Tokyo (JP)

( * ) Notice: Subject to any disclaimer, the term of this patent is extended or adjusted under 35 U.S.C. 154(b) by 304 days.

(21) Appl. No.: 15/543,184

(22) PCT Filed: Jan. 19, 2016

(86) PCT No.: PCT/JP2016/051417

§ 371 (c)(1),
(2) Date: Jul. 12, 2017

(87) PCT Pub. No.: WO2016/121571

PCT Pub. Date: Aug. 4, 2016

(65) Prior Publication Data

US 2017/0371273 A1 Dec. 28, 2017

(30) Foreign Application Priority Data

Jan. 28, 2015 (JP) ..... 2015-014417

(51) Int. Cl.
*G03G 15/09* (2006.01)
*H01F 7/02* (2006.01)
(Continued)

(52) U.S. Cl.
CPC ..... *G03G 15/0942* (2013.01); *H01F 7/0247* (2013.01); *H01F 7/0273* (2013.01);
(Continued)

(58) Field of Classification Search
CPC ..... G03G 15/0921; G03G 15/0942; G03G 15/09; H01F 13/003; H01F 1/0551;
(Continued)

(56) References Cited

U.S. PATENT DOCUMENTS 3,578,150 A * 5/1971 Pirovano ..... A01K 5/0258 198/659
4,324,493 A * 4/1982 Colombo ..... B29C 48/834 366/79

(Continued)

FOREIGN PATENT DOCUMENTS

CN 102693811 A 9/2012
JP S63-133816 A 6/1988

(Continued)

OTHER PUBLICATIONS

Office Action dated Jun. 12, 2018, for corresponding Japanese application No. 2016-571958, including an English translation, 8 pages.

(Continued)

*Primary Examiner* — Matthew J Daniels
*Assistant Examiner* — Yunju Kim
(74) *Attorney, Agent, or Firm* — Peter W. Schroen; Bret E. Field; Bozicevic, Field & Francis LLP

(57) ABSTRACT

A molding device for molding a magnet roll with a profiled cross-section comprises a heating and kneading unit that supplies, to a cylindrical metal mold, a kneaded material obtained by heating and kneading a raw mixture including ferromagnetic particles and thermoplastic resin, an extrusion molding unit that molds the supplied kneaded material by the metal mold, and a magnetic field generating unit disposed at an end portion of the metal mold in a lengthwise direction that generates a magnetic field inside the metal mold, and the metal mold has a profiled C-shaped cross- (Continued)

section at an inlet for the kneaded material and a profiled cross-section at an outlet for the kneaded material more complex than the inlet.

10 Claims, 9 Drawing Sheets

(51) Int. Cl.
*H01F 41/02* (2006.01)
*H01F 13/00* (2006.01)
*H01F 1/055* (2006.01)

(52) U.S. Cl.
CPC ..... *H01F 13/003* (2013.01); *H01F 41/0266* (2013.01); *H01F 41/0273* (2013.01); *G03G 15/0921* (2013.01); *H01F 1/0551* (2013.01)

(58) Field of Classification Search
CPC ..... H01F 41/0266; H01F 41/0273; H01F 7/0247; H01F 7/0273; H01F 7/02; C04B 35/40; B29C 48/58; B29C 48/146
USPC ..... 264/427; 252/62.57
See application file for complete search history.

(56) References Cited

U.S. PATENT DOCUMENTS

| | | | | |
|---|---|---|---|---|
| 4,517,539 | A | 5/1985 | Sakata | |
| 5,384,957 | A | 1/1995 | Mohri et al. | |
| 6,070,038 | A | 5/2000 | Imamura et al. | |
| 6,496,675 | B1 * | 12/2002 | Sugiyama | G03G 15/0921 399/277 |
| 6,500,374 | B1 | 12/2002 | Akioka et al. | |
| 2009/0218540 | A1 * | 9/2009 | Takami | C01G 49/0018 252/62.57 |
| 2013/0026863 | A1 | 1/2013 | Asai | |

FOREIGN PATENT DOCUMENTS

| | | | |
|---|---|---|---|
| JP | H8-127080 | A | 5/1996 |
| JP | H9-120927 | A | 5/1997 |
| JP | H9-148166 | A | 6/1997 |
| JP | H9-275028 | A | 10/1997 |
| JP | H11-162731 | A | 6/1999 |
| JP | 2002-43119 | A | 2/2002 |
| JP | 2003-100511 | A | 4/2003 |
| JP | 2005-195974 | A | 7/2005 |
| JP | 2008-244322 | A | 10/2008 |
| JP | 2013-021191 | A | 1/2013 |
| WO | WO9803981 | A1 | 1/1998 |
| WO | WO2012105226 | A1 | 8/2012 |

OTHER PUBLICATIONS

English Translation of International Search Report for PCT/JP2016/051417 dated Feb. 23, 2016, 4 pages.
Office Action for Chinese Patent Application No. 201680006221.7, dated Jul. 3, 2019, 7 pages.
Office Action for Chinese Patent Application No. 201680006221.7, dated Jan. 15, 2020, and its English translation, 19 pages.

* cited by examiner

MOLDING DEVICE, METAL MOLD, METHOD OF MANUFACTURING MAGNET ROLL AND METHOD OF MAGNETIZING MAGNET ROLL

CROSS-REFERENCE TO RELATED APPLICATIONS

This application is the national phase under 35 U. S. C. § 371 of PCT International Application No. PCT/JP2016/051417 which has an International filing date of Jan. 19, 2016 and designated the United States of America.

FIELD

The present invention relates to a molding device used for manufacturing a magnet roll served as a developing roll utilized in electrophotography, electrostatic recording, etc., a metal mold, a method of manufacturing a magnet roll, and a method of magnetizing a magnet roll.

BACKGROUND

A magnet roll employed as a developing roll in electrophotography, electrostatic recording, etc. is circumferentially provided with a plurality of magnetic poles and a non-magnetized portion, that is, a demagnetized pole. The position, number, size and shape of the magnetic poles for a magnet roll depend on the specifications of developer to be attracted and electrophotographic device and the like.

For example, Japanese Patent Application Laid-Open Publication No. 2003-100511 discloses a magnet roll that is integrally formed to have a circular cross-section with a partial cut-away demagnetized pole, that is, a C-shaped cross-section.

Japanese Patent Application Laid-Open Publication No. 2002-43119 discloses a magnet roll that is made up of a plurality of bar magnets to have a profiled cross-section in order to obtain a desired magnetic waveform.

SUMMARY

The method of manufacturing a magnet roll includes extrusion molding. When a mixture of resin and magnetic particles is extruded through a metal mold by extrusion molding to produce a magnet roll, the extruded molding may partially be curved. This problem is caused by the varying resistance between the mixture and the metal mold depending on the parts of the metal mold when the mixture is extruded from the metal mold. The mixture is more difficult to be extruded at a part with a high resistance than at a part with a low resistance. Even when the extrusion force dominates the resistance to avoid a curve of the molding, irregularities will occur on the surface of the molding. Such a problem arises more easily upon forming a molding with a profiled cross-section than upon forming a molding with a C-shaped cross-section.

The present invention is achieved in view of the above-mentioned circumstances, and aims at providing a molding device or the like that are able to reduce the occurrence of a curve and surface irregularities of the molding serving as a magnet roll with a profiled cross-section upon extrusion molding.

It is noted that a profiled C-shaped cross-section in the specification is a curved-surface portion of a circular cross-section or a partially cut-away C-shaped cross-section which is partially deformed to have at least any one of a protrusion portion, a depression portion and a flat portion, or connected circular arcs each having different curvature. Any combination of a protrusion portion, a depression portion, a flat portion and connected circular arcs each having different curvature may be possible for the cross-section. Meanwhile, a complex profiled cross-section applies to a case with more irregularities and more portions to be combined than a cross-section to be compared.

In a molding device for molding a magnet roll with a profiled cross-section according to the present invention comprises a heating and kneading unit that supplies, to a cylindrical metal mold, a kneaded material obtained by heating and kneading a raw mixture including ferromagnetic particles and thermoplastic resin, an extrusion molding unit that molds the supplied kneaded material by the metal mold, and a magnetic field generating unit disposed at an end portion of the metal mold in a lengthwise direction that generates a magnetic field inside the metal mold, the metal mold has a profiled C-shaped cross-section at an inlet for the kneaded material and a profiled cross-section at an outlet for the kneaded material more complex than the inlet.

According to the present invention, the metal mold has the profiled C-shaped cross-section at the inlet for the kneaded material and the profiled cross-section at the outlet for the kneaded material more complex than the inlet. This makes it possible to lower the resistance when the kneaded material is supplied to the metal mold and reduce the occurrence of a curve and surface irregularities of the magnet roll when the magnet roll with a profiled cross-section is extruded and molded.

In the molding device according to the present invention, the inlet has a cross-sectional area equal to or larger than the cross-sectional area of the outlet.

According to the present invention, the cross-sectional area of the inlet of the metal mold is larger than the cross-sectional area of the outlet of the metal mold. This makes it possible to lower the resistance when the kneaded material is supplied to the metal mold and reduce the occurrence of a curve and surface irregularities of the magnet roll when the magnet roll with a profiled cross-section is extruded and molded.

In the molding device according to the present invention, the outlet of the metal mold is provided with a protruding portion that protrudes in an extrusion direction so as to encircle the outlet and a flange portion that is circumferentially provided on an outer surface of the outlet.

According to the present invention, the protruding portion allows a molding which has been extruded from the metal mold to be immediately cooled, which prevents the molding from being deformed.

The molding device according to the present invention further comprises a cooling unit that cools a molding formed of the kneaded material that has been extruded from the outlet.

According to the present invention, the molding that has just been extruded from the metal mold can immediately be cooled, which prevents the molding from being deformed.

The metal mold according to the present invention for extruding and molding a magnet roll comprises an inlet having a profiled C-shaped cross-section and an outlet having a profiled cross-section more complex than the inlet, and a diminishing-diameter portion where an internal surface progressively diminishes in diameter from the inlet having the profiled C-shaped cross-section to the outlet having the profiled cross-section.

According to the present invention, the metal mold has a diminishing-diameter portion where the internal surface progressively diminishes in diameter from the inlet having the profiled C-shaped cross-section to the outlet having the profiled cross-section. This makes it possible to reduce the resistance when the kneaded material is supplied to the metal mold and reduce the occurrence of a curve and surface irregularities of the magnet roll when the magnet roll with a profiled cross-section is extruded and molded.

In a method of manufacturing a magnet roll with a profiled cross-section according to the present invention comprising a heating and kneading step of heating and kneading a raw mixture including ferromagnetic particles and thermoplastic resin and supplying the kneaded material that has been heated and kneaded to a cylindrical metal mold, an extrusion molding step of molding the supplied kneaded material by the metal mold, and a magnetic field orientation step of orienting the ferromagnetic particles in the molded molding, and in the extrusion molding step, the kneaded material is molded to have a profiled cross-section more complex than a C-shaped cross-section while gradually diminishing in diameter from the C-shaped cross-section.

According to the present invention, in the extrusion molding step, the kneaded material is molded to have the profiled cross-section more complex than the C-shaped cross-section while gradually diminishing in diameter from the C-shaped cross-section. This makes it possible to lower the resistance when the kneaded material is supplied to the metal mold and reduce the occurrence of a curve and surface irregularities of the magnet roll when the magnet roll with a profiled cross-section is extruded and molded.

A method of magnetizing a magnet roll with a profiled cross-section having a magnetic central shaft about a central axis according to the present invention comprises: disposing a yoke around which a magnetization coil is wound at a position corresponding to each of a plurality of positions where magnetic poles of the magnet roll are to be formed, disposing one yoke at a position closer to the central shaft than another yoke, and causing the one yoke to generate a magnetization magnetic field in a direction different from directions of other yokes adjacent to the one yoke.

According to the present invention, one yoke is disposed closer to the central shaft than another yoke, and the one yoke generates the magnetization magnetic field in the direction different from the directions of the other yokes adjacent to the one yoke. This enables the surface magnetic flux density to be 0 at a predetermined position of the magnet roll.

According to the present invention, it is possible to reduce the occurrence of a curve and surface irregularities of the magnet roll when a magnet roll with a profiled cross-section is extruded.

DETAILED DESCRIPTION

Embodiment 1

Figure 1:
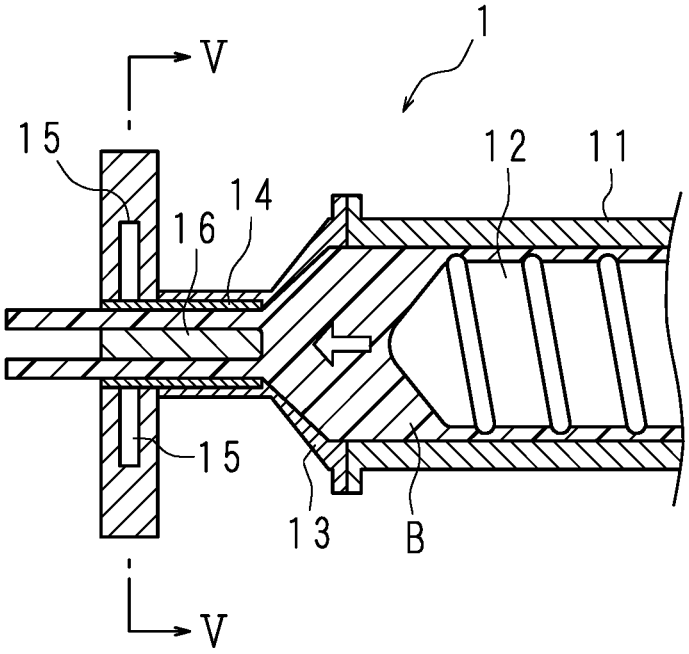
FIG. 1 is an axial cross-sectional view illustrating the principle components of an extruder.

The present invention will be described in detail below with reference to the drawings illustrating the embodiment thereof. FIG. 1 is an axial cross-sectional view illustrating the principle components of an extruder (molding device) 1. The extruder 1 includes a cylinder 11, a screw 12, a metal mold attachment portion 13, a metal mold 14, an orientation magnet 15 and a magnetic shaft 16.

The cylinder 11 is cylindrical and accommodates the screw 12. Around an outer peripheral of the cylinder 11, a heater unit (not illustrated) is provided. The heater unit is controlled to optimize the temperature inside the cylinder 11. As the heater unit, a band heater, an aluminum cast sheathed heater or the like is used. The cylinder 11 is supplied with a raw material (raw mixture) used for molding a magnet roll by a hopper (not illustrated).

The raw material for molding is prepared by mixing ferromagnetic particles and thermoplastic resin with a mixer, grinding the mixture to a grain size of a few mm or smaller and then granulating the resultant.

The ferromagnetic powder forming the ferromagnetic particles is ferrite magnetic powder such as barium ferrite and/or strontium ferrite, strontium ferrite magnetic powder containing La and Co, calcium ferrite magnetic powder containing La and Co, R—Co, R—Fe—B or R—Fe—N rare-earth magnetic powder, or a mixed powder of the ferrite magnetic powder and the rare-earth magnetic powder.

The thermoplastic resin is, for example, polyethylene, polyvinyl chloride, polyacetal, ethylene-ethyl-acrylate (EEA) copolymer resin, ethylene-vinyl acetate (EVA) copolymer, and acrylonitrile-butadiene-styrene (ABS) copolymer resin.

The screw 12 rotates inside the cylinder 11 to knead the raw material for molding and convey it from the right to left on the sheet in FIG. 1. The heating and kneading unit according to the present specification includes the cylinder 11, the screw 12 and the heater unit.

The metal mold attachment portion 13 has a hollow cylindrical structure that diminishes in diameter. The metal mold attachment portion 13 is connected to the cylinder 11 at one end with a large diameter and is connected to the metal mold 14 at the other end with a diminished diameter.

Figure 2:
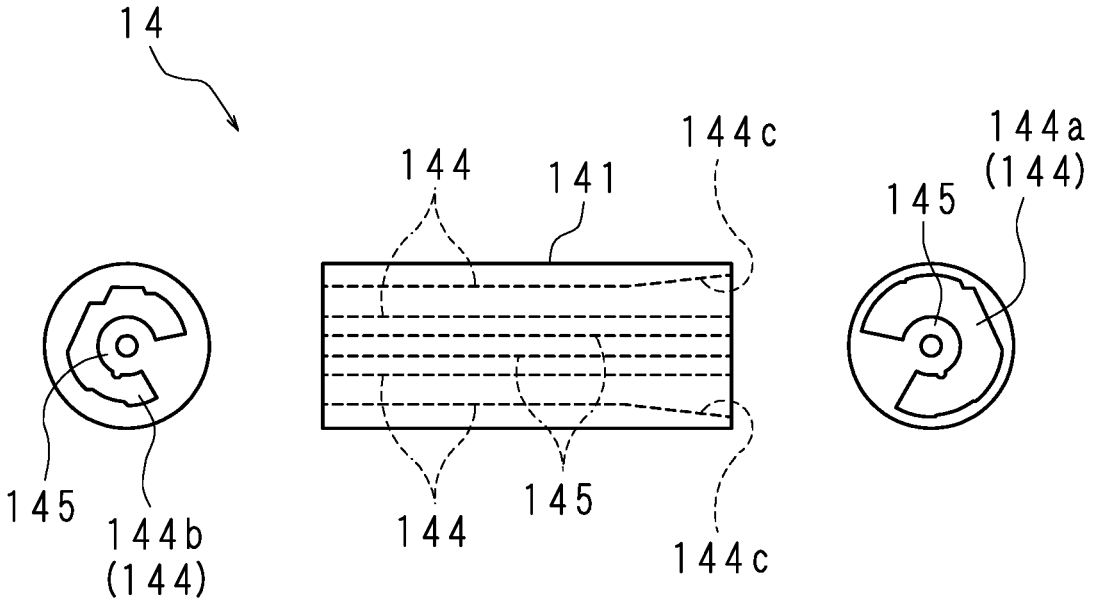
FIG. 2 is an illustrative view illustrating one example of the configuration of a metal mold.

The metal mold 14 molds the kneaded raw material for molding (kneaded material) to a predetermined shape. FIG. 2 is an illustrative view illustrating one example of the configuration of the metal mold 14. On the right side of FIG. 2, there is illustrated a plan view of an inlet 144*a* to which the kneaded material is supplied. At the center of FIG. 2, there is illustrated a side view of the metal mold 14. On the left side of FIG. 2, there is illustrated a plan view of an outlet 144*b* from which a molding formed of the kneaded material is extruded. The metal mold 14 is cylindrical and has a shaft-accommodating portion 145 about its central axis. The shaft-accommodating portion 145 has a central hole at the center thereof that accommodates a magnetic shaft used for magnetic field orientation of the kneaded material, and defines the inner peripheral surface of the profiled C-shaped cross-section. Around the shaft-accommodating portion 145, a passage 144 is defined. It is noted that the dotted lines illustrated in the side view at the center of FIG. 2 indicate, for example, connected portions between a plurality of walls that form the passage 144 (bending points of the inner surface of the metal mold 14), and the central hole of the shaft-accommodating portion 145.

As can be seen on the left side of FIG. 2, the outlet 144*b* from which the molding is to be extruded is profiled like a magnet roll. As can be seen on the right side of FIG. 2, the inlet of the passage 144, that is, the inlet 144*a* for a raw material for molding is profiled but substantially C-shaped unlike the outlet 144*b*.

The cross-sectional shape of the outlet 144*b* is more complex than that of the inlet 144*a*.

In other words, the difference between the distances from the adjacent depression portion and projection portion to the central axis at the outlet 144*b* is larger than the difference between the distances from the adjacent depression portion and projection portion to the central axis at the inlet 144*a*.

The outer diameter of the shaft-accommodating portion 145 is the same on both sides of the inlet 144*a* and the outlet 144*b* of the metal mold 14, and the inner diameter of the shaft-accommodating portion 145 is larger at the inlet 144*a* than at the outlet 144*b* of the metal mold 14. The cross-sectional area of the inlet 144*a* of the metal mold 14 is made equal to or larger than that of the outlet 144*b* of the metal mold 14. The metal mold 14 has a diminishing-diameter portion 144*c* where the inner surface progressively tilts toward the center for a predetermined distance from the inlet 144*a*. The extrusion molding unit according to the present specification includes the metal mold attachment portion 13 and the metal mold 14.

At the outer peripheral edge of the outlet 144*b* of the metal mold 14, a plurality of orientation magnets 15 are disposed. The orientation magnets 15 (magnetic field generating unit) are for performing magnetic field orientation on the kneaded material. The orientation magnet 15 is a permanent magnet such as a bond magnet and a neodymium magnet, for example. It is noted that the orientation magnet 15 may use an electromagnet including a yoke and a coil wound around the yoke other than the permanent magnet.

A magnetic shaft 16 is inserted into and placed at the central hole of the shaft-accommodating portion 145 of the metal mold 14.

Figure 3:
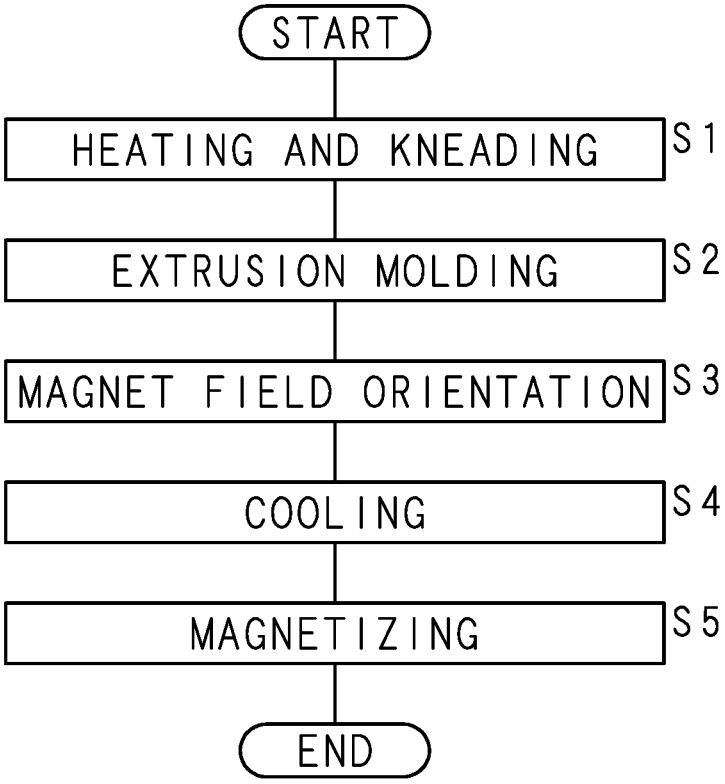
FIG. 3 is a flowchart illustrating one example of the manufacturing process of a magnet roll.

The following describes the process of manufacturing a magnet roll. FIG. 3 is a flowchart illustrating one example of the process of manufacturing a magnet roll. The process of manufacturing a magnet roll includes a heating and kneading step (step S1), an extrusion molding step (step S2), a magnetic field orientation step (step S3), a cooling step (step S4) and a magnetizing step (step S5).

In the heating and kneading step (step S1), a raw material for molding supplied from the hopper (not illustrated) of the extruder 1 is heated by a heater (also not illustrated) while kneaded by the screw 12 and conveyed inside the cylindrical cylinder 11 from right to left on the sheet of FIG. 1.

The extrusion molding step is then performed (step S2). The kneaded material B conveyed through the cylinder 11 by the screw 12 is supplied to the metal mold 14 through the metal mold attachment portion 13. The kneaded material B is molded by passing through the metal mold 14. The magnetic field orientation step (step S3) is executed concurrently with the final stage of the extrusion molding step. As illustrated in FIG. 1, the orientation magnets 15 are disposed near the outlet of the metal mold 14. The kneaded material B is subjected to magnetic field orientation by the orientation magnets 15 before being extruded from the metal mold 14. That is, the ferromagnetic particles contained in the kneaded material B are oriented in a predetermined direction, which determines the direction of the magnetic field of the kneaded material B. It is noted that the raw material for molding supplied to the metal mold 14, which has already been naturally cooled while passing through the metal mold 14, has enough viscosity for the orientation of the ferromagnetic particles in the magnetic field orientation step.

The cooling step is next performed (step S4). The molded kneaded material that has been extruded from the metal mold 14, that is, the molding is cooled by a coolant or the like. The molding is finally hardened by being cooled.

The molding that is finally hardened is cut to a predetermined length and is subjected to the magnetizing step (step S5). In the magnetizing step, the molding is magnetized by the magnetization magnets including a yoke made of a soft magnetic material and a coil wound around the yoke (magnetization coil), which completes a magnet roll. The details will be described later.

Figure 4:
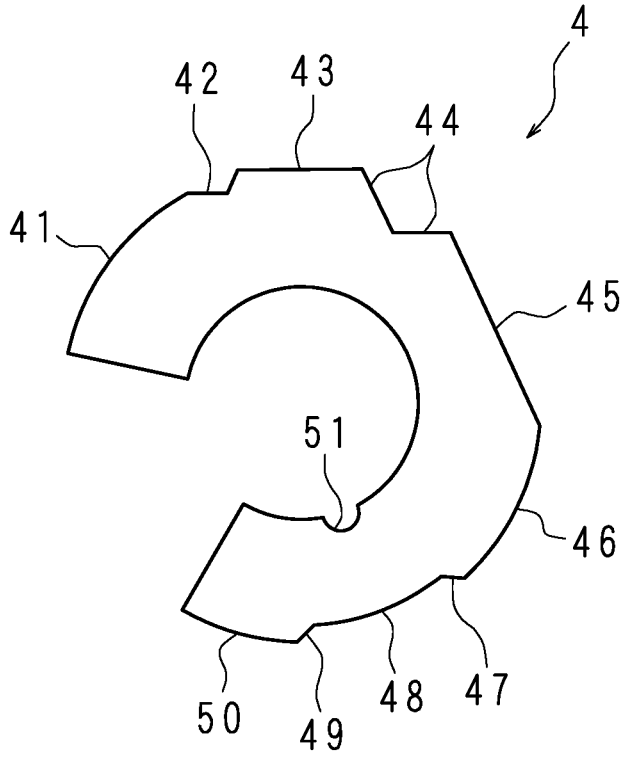
FIG. 4 is an illustrative view illustrating one example of an end surface of the magnet roll.

FIG. 4 is an illustrative view illustrating one example of the end surface of the magnet roll 4. FIG. 4 is a profiled cross-section formed by a partially cut-away cylinder, i.e., a C-shaped cross-section, which is partially deformed to have flat portions, depression portions depressed in a radial direction, and curved portions with different curvatures. FIG. 4 illustrates the end surface of the magnet roll 4. The end surface of the magnet roll 4 includes a first curved portion 41, a second curved portion 46, a third curved portion 48, a fourth curved portion 50, a first flat portion 43, a second flat portion 45, a first connection portion 42, a second connection portion 44, a third connection portion 47, a fourth connection portion 49 and a key groove portion 51.

Each of the first curved portion 41, the second curved portion 46, the third curved portion 48 and the fourth curved portion 50 is an arc of a circle with the central axis as the center when seen from the end surface of the magnet roll 4 in plan view. The radiuses of all the arcs may have the same length, or the radiuses of some arcs may have the same length while the radiuses of the other arcs may have different lengths. The length of the radius of each arc is appropriately decided by the specification of the waveform of the surface magnetic flux of the magnet roll 4.

Each of the first flat portion 43 and the second flat portion 45 is substantially vertical to the radius of the circle with the central axis as the center when seen from the end surface of the magnet roll 4 in plan view. In other words, the direction of the normal of the plane including the first flat portion 43 and the second flat portion 45 is substantially parallel with the radial direction.

The first connection portion 42 connects the first curved portion 41 and the first flat portion 43. The first connection portion 42 is formed by two connected straight lines when the magnet roll 4 is seen from its end surface in plan view. The first connection portion 42 is recessed when viewed from the outer circumferential surface, and forms a channel overall.

The second connection portion 44 connects the first flat portion 43 and the second flat portion 45. The contour of the second connection portion 44 is similar to that of the first connection portion 42.

The third connection portion 47 connects the second curved portion 46 and the third curved portion 48. The third connection portion 47 is formed by a straight line when the magnet roll 4 is seen from its end surface in plan view.

The fourth connection portion 49 connects the third curved portion 48 and the fourth curved portion 50. The contour of the fourth connection portion 49 is similar to that of the third connection portion 47.

The key groove portion 51 is a groove into which a key for fixing the magnet roll 4 with the central shaft of the magnet roll 4 is to be inserted.

The numbers of curved portions, flat portions and connection portions of the magnet roll 4 illustrated in FIG. 4 are merely one example. The combination of the curved portions, the flat portions and the connection portions is appropriately decided by the specification of the waveform of the surface magnetic flux of the magnet roll 4.

For extrusion molding of a molding serving as a magnet roll, the conventional metal mold has the inlet and the outlet of the same shape. Thus, in the case that a molding with a complex profiled cross-section is molded, the inlet and the outlet of the metal mold are also formed to have the same profiled cross-section. However, the cross-section of the inner side of the metal mold attachment portion 13 is circular, and the kneaded material extruded by the screw 12 thus having a circular cross-section is supplied from the inlet of the metal mold with a profiled cross-section to the interior thereof. The metal mold having a profiled cross-section has more irregularities than the metal mold having a circular cross-section or a C-shaped cross-section. This causes a large coefficient of friction between the metal mold and the kneaded material at the inlet of the metal mold. Also, varying resistance between the interior of the metal mold and the kneaded material arises depending on the parts while the kneaded material progresses in the interior of the metal mold. Thus, the molding extruded by the conventional metal mold can be curved overly because of the resistance or can have irregularities on the surface thereof because of the varying resistance. To prevent such problems, the extrusion rate of the kneaded material need to be decreased, resulting in an increase of a molding time period.

In contrast thereto, the metal mold 14 according to Embodiment 1 has a simpler shape and a wider opening at the inlet 144*a* than the outlet 144*b*. This makes it possible to reduce the resistance when the kneaded material is supplied from the inlet 144*a* in comparison with the conventional metal mold. The diminishing-diameter portion 144*c* also allows the kneaded material to be gradually molded from the profiled substantially-C shape to a complex profiled shape, which reduces the resistance when the kneaded material flows through the interior of the metal mold 14 in comparison with the conventional metal mold. This makes it possible to prevent the magnet roll from being curved and prevent the irregularities on the surface of the magnet roll from being created due to the varying resistance. Furthermore, low resistance between the metal mold 14 and the kneaded material in comparison with the conventional metal mold enables a molding free from the above-mentioned problems even when the extrusion rate of the kneaded material is increased.

Figure 5:
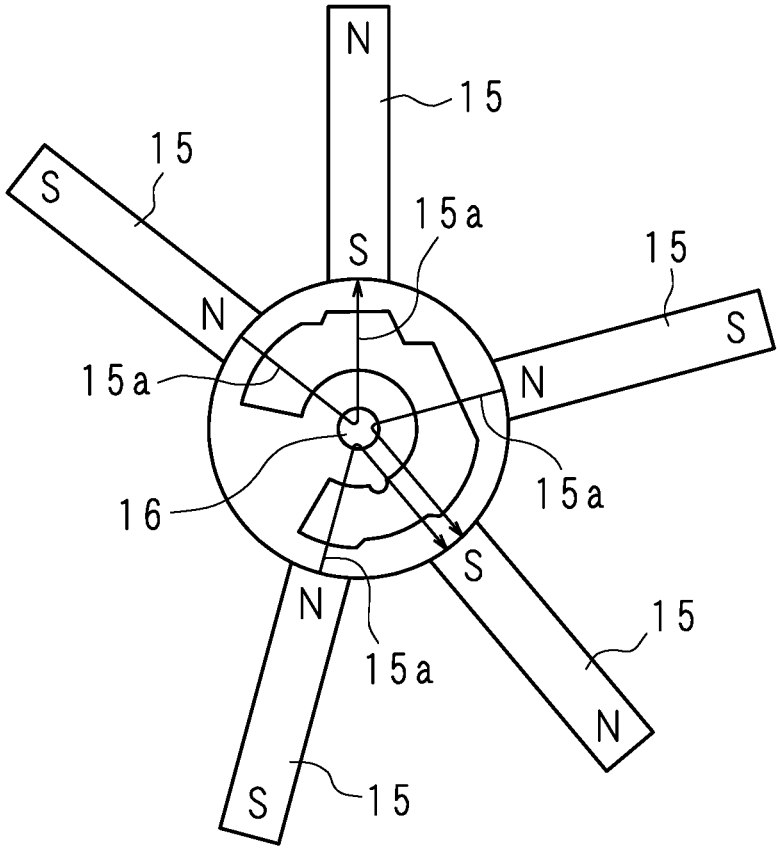
FIG. 5 is a cross-sectional view taken along line V-V in FIG. 1.

In Embodiment 1, the magnetic field orientation process is performed with the magnetic shaft 16 inserted into the shaft-accommodating portion 145 formed about the central axis of the metal mold 14. FIG. 5 is a cross-sectional view taken along the line V-V in FIG. 1. The cross-section is illustrated without hatching in FIG. 5. As illustrated in FIG. 5, a plurality of orientation magnets 15 are circumferentially disposed on the outer circumferential surface of the metal mold 14. The position of each of the orientation magnets 15 is decided by the cross-sectional shape of the molding and the specification of the magnetic poles to be formed. In the magnetic field orientation step, the magnetic circuit is composed of the orientation magnets 15 and the magnetic shaft 16. In FIG. 5, the curve lines denoted by reference numeral 15*a* illustrate the flow of the magnetic flux in the magnetic circuit composed of the orientation magnets 15 and the magnetic shaft 16. Disposition of the magnetic shaft 16 enables the magnetic flux to flow to surely penetrate the kneaded material. Accordingly, the magnetic field orientation of the kneaded material is made possible through the effective use of the magnetic field of the orientation magnets 15.

Embodiment 2

Figure 6:
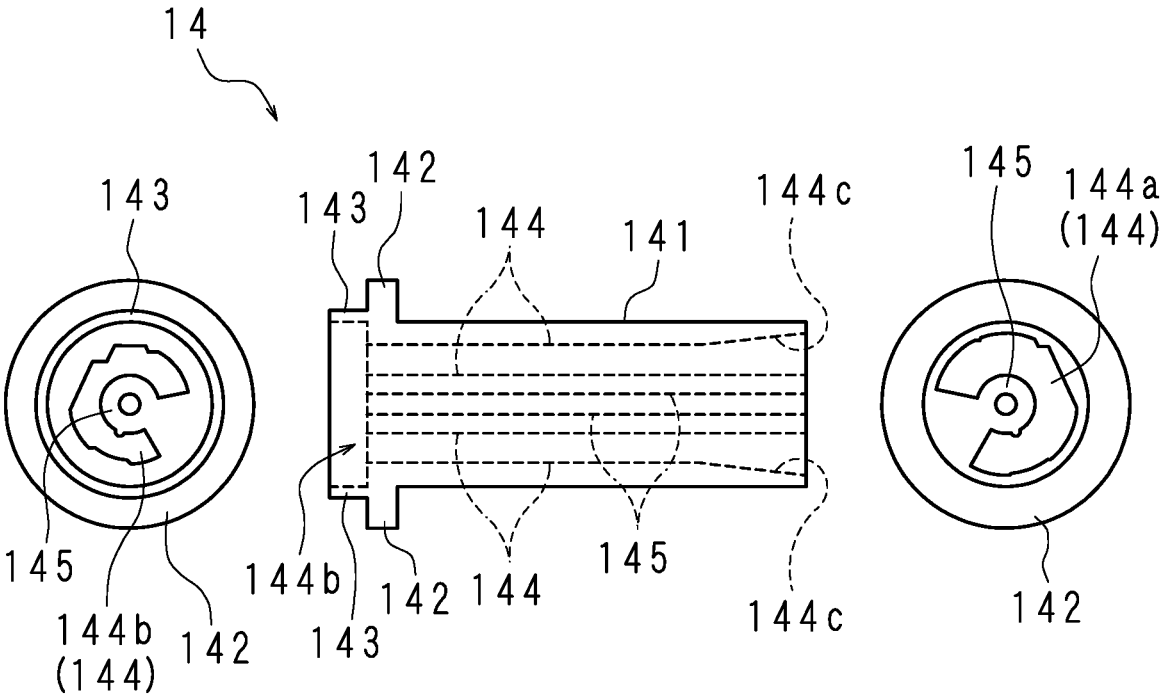
FIG. 6 is an illustrative view illustrating one example of the configuration of a metal mold.

FIG. 6 is an illustrative view illustrating one example of the configuration of a metal mold. In Embodiment 2, the metal mold 14 includes a flange portion 142 and a protruding portion 143 as well as a main body portion 141, a passage 144 and a shaft-accommodating portion 145. The description as to the parts similar to Embodiment 1 will be omitted.

In Embodiment 2, at the outer edge of the outlet 144*b* of the metal mold 14, the protruding portion 143 protruding toward the extrusion direction of the molding is provided so as to encircle the outlet 144*b*. The flange portion 142 extending radially outward is provided around the root of the protruding portion 143. The flange portion 142 is circumferentially provided on the outer surface of the outlet 144*b*. The protruding portion 143 forwardly protrudes from the end portion of the flange portion 142 beyond the outlet 144*b* of the passage 144. The protruding portion 143 serves as a wall to encircle the outlet 144*b*.

Figure 7:
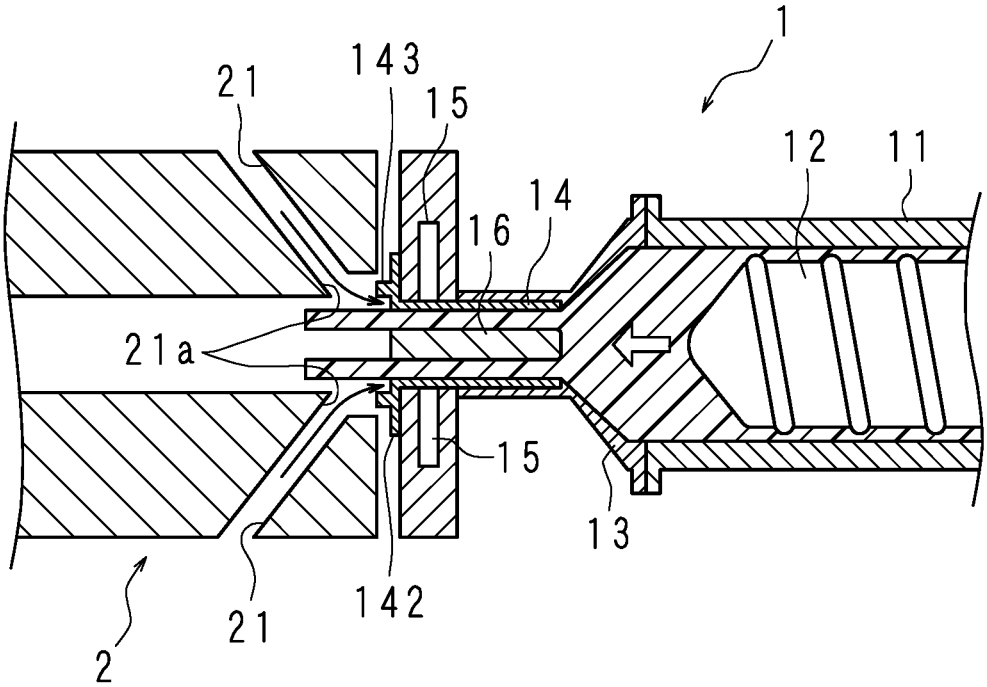
FIG. 7 is a vertical cross-sectional view illustrating principle components of the extruder with a cooling unit connected.

FIG. 7 is a vertical cross-sectional view illustrating the principle components of an extruder 1 with the cooling unit 2 connected. The cooling unit 2 is cylindrical, and provided with a liquid supplying opening 21*a* on the surfaces opposing the metal mold 14 such that the molding extruded from the metal mold 14 is surrounded. The cooling unit 2 is disposed coaxially to the metal mold 14. The cooling unit 2 is provided with a liquid supplying passage 21 communicating with the liquid supplying opening 21*a*. The molding extruded from the outlet 144*b* of the metal mold 14 still has a high temperature and is easily deformed when is extruded. This requires the molding to be fully cooled by the cooling unit 2. As illustrated in FIG. 7, the coolant passing through the liquid supplying passage 21 is supplied from the liquid supplying opening 21*a* provided near the outlet of the metal mold 14 to thereby cool the molding. The coolant may be tap water, water for industrial use, but may be circulating water and other coolants without being limited thereto.

The conventional metal mold has difficulty in immediately cooling the extruded molding because of its shape and attachment method. In contrast thereto, the metal mold 14 according to Embodiment 2 is provided with the flange portion 142 and the protruding portion 143. Provision of the flange portion 142 and the protruding portion 143 allows the coolant supplied from the liquid supplying openings 21*a* to be accumulated around the molding, which enables efficient cooling of the molding. This makes it possible to prevent the molding from being deformed.

Method of Magnetizing Magnet Roll

Figure 8:
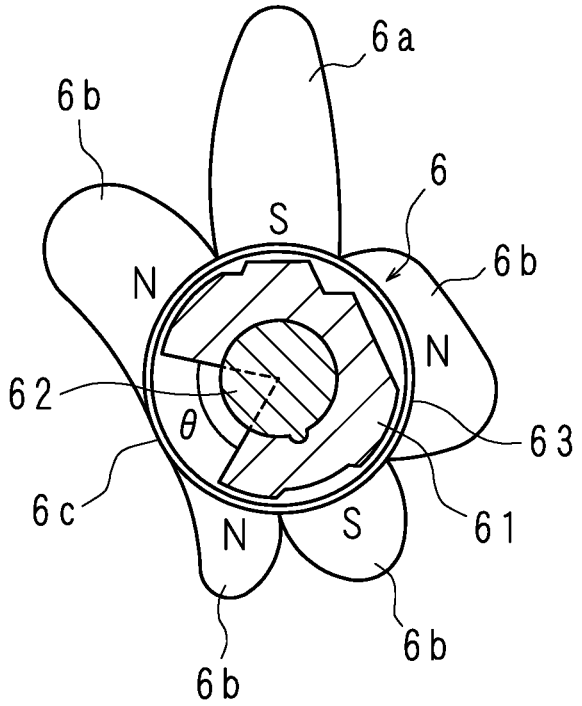
FIG. 8 is a vertical cross-sectional view illustrating one example of a developing roll and is an illustrative view illustrating one example of the waveform of the surface magnetic flux density of the developing roll.

The following describes a method of magnetizing a magnet roll according to Embodiment 1 and Embodiment 2. FIG. 8 is a vertical cross-sectional view illustrating one example of a developing roll 6 and an illustrative view illustrating one example of the waveform of the surface magnetic flux density of the developing roll 6. The developing roll 6 includes a magnet roll 61, a central shaft 62 and a sleeve 63.

The magnet roll 61 is similar to the magnet roll 4 described in Embodiment 1 or Embodiment 2. The central shaft 62 is a shaft disposed about the central axis of the magnet roll 61. The sleeve 63 is cylindrical and accommodates the magnet roll 61 with the central shaft 62 located in the hollow portion.

The N pole and the S pole are alternately disposed on the circumferential surface of the developing roll 6 along the circumferential direction. The magnetic pole of the developing roll 6 can be classified into a main magnetic pole 6*a*, an auxiliary magnetic pole 6*b* and a demagnetized pole 6*c*, for example. The main magnetic pole 6*a* adheres toner powder used during development to the surface of the sleeve 63. The auxiliary magnetic pole 6*b* assists formation of the magnetic force of the main magnetic pole 6*a*. The demagnetized pole 6*c* demagnetizes the toner powder adhered to the sleeve 63. It is preferable that the demagnetized pole 6*c* has the magnetic flux density of 0.

The position of the magnet roll 61 corresponding to the demagnetized pole 6*c* is a section where the central shaft 62 is exposed without being covered by the magnet. The section is hereafter referred to as a "cut-away portion" for convenience. A sector is formed by the cut-away portion and parts of the central shaft 62 and the sleeve 63. In the example in FIG. 8, the central angle θ of the sector is assumed as about 70 degrees. Hereinafter, the angle of the central angle θ is called "the angle of the cut-away portion" for convenience.

Figure 9:
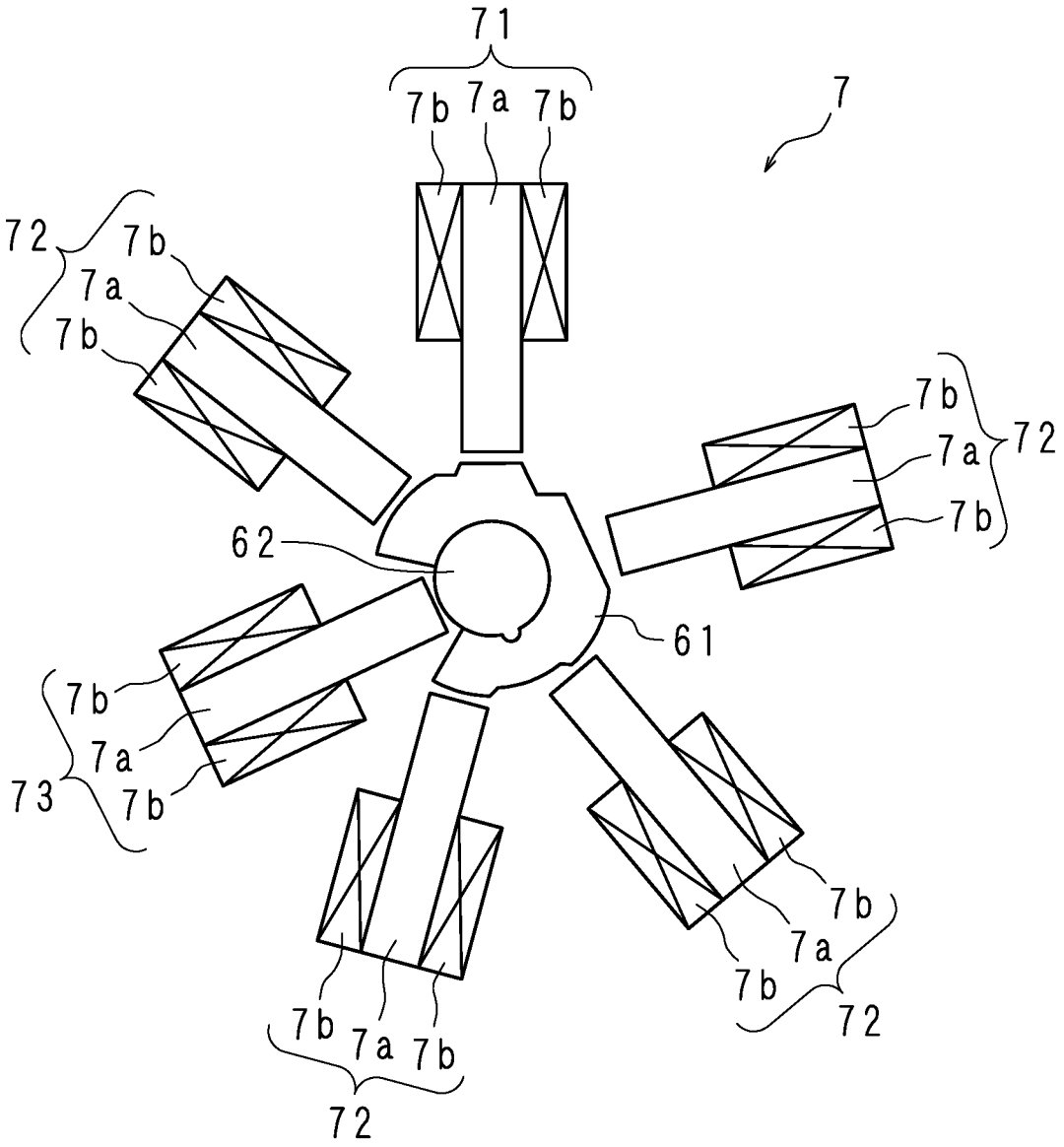
FIG. 9 is an illustrative view illustrating a method of magnetizing the magnet roll.

FIG. 9 is an illustrative view illustrating a method of magnetizing the magnet roll 61. The magnet roll 61 is magnetized after the central shaft 62 made of magnet has been inserted into the central axis. A magnetizing device (magnetizing unit) 7 includes a plurality of electromagnets 71, 72, 73. The electromagnets 71, 72, 73 are provided along substantially the circumferential direction of the magnet roll 61. The electromagnets 71, 72, 73 each includes a yoke 7*a* made of a soft magnetic material and a coil 7*b* wound around the yoke 7*a*. An exciting device (not illustrated) causes a predetermined amount of current to flow into each coil 7*b* to generate a magnetic field of a required orientation of the magnetic pole and a required magnitude (magnetization magnetic field). The yokes 7*a* of the respective electromagnets 71, 72, 73 are disposed such that the magnetic fields generated for the electromagnets 71, 72, 73 are oriented in the substantially radial direction of the magnet roll 61. For example, the magnet roll 61 can be magnetized along the axial direction by being moved from the back side to the front side of the drawing. Alternatively, the magnet roll 61 may be magnetized at a time by preparation of the yokes 7*a* and the coils 7*b* each of which are connected from the back side to the front side by the length of the magnet roll 61.

The electromagnet 71 out of the electromagnets illustrated in FIG. 9 is magnetized to have the main magnetic pole. Each of the plurality of electromagnets 72 is magnetized to have the auxiliary magnetic pole. The electromagnet 73 hinders the demagnetized pole from being magnetized. The provision of the electromagnet 73 is a difference with the conventional art.

The following describes the significance of the provision of the electromagnet 73 for the demagnetized pole. In the case that magnetic poles having the same polarity are present adjacent to or on both sides of the demagnetized pole, a magnetic pole having a polarity different from the adjacent magnetic poles (different magnetic pole) may occur at the position of the demagnetized pole although the magnetic flux density of the demagnetized pole of 0 is preferable as described above.

In the example in FIG. 8, the auxiliary magnetic poles on both sides of the demagnetized pole 6*c* have the N pole, and thus, the S pole may occur at the demagnetized pole 6*c*.

In the case that the angle of the cut-away portion forming the demagnetized pole is small, that is, about 40 degrees, for example, parts being in contact with the demagnetized pole (both ends of the C-shaped cross-section) hinder formation of the different pole that is generated so as to be pushed out from the adjacent magnetic poles, resulting in no magnetic poles at the demagnetized pole. However, in the case that the angle of the cut-away portion is 70 degrees as illustrated in FIG. 8, the different magnetic pole is pushed out and formed at the position of the demagnetized pole 6*c*. To cancel out such a magnetic pole being formed, the electromagnet 73 is provided for magnetization.

The magnetic field generated in the electromagnet 73 is set to have an opposite orientation to the magnetic fields generated in the electromagnets 72 on both sides of the electromagnet 73. The electromagnet 73 is disposed such that the tip end portion of the yoke 7*a* is opposed to the central shaft 62. It is preferable that the tip end portion of the yoke 7*a* of the electromagnet 73 is placed closer to the inner side than the outermost portion of the magnetic role 61 forming the magnetic poles at least on both sides of the demagnetized pole 6*c*. It is more preferable that the tip end portion of the yoke 7*a* of the electromagnet 73 is placed close enough to contact the central shaft 62.

The magnetizing method described in the specification above avoids formation of the magnetic pole at the demagnetized pole even when the angle of the cut-away portion forming the demagnetized pole is large.

The technical features (components) described in the respective embodiments can be combined with each other, and by the combination, a new technical feature can be created.

It is to be noted that, as used herein and in the appended claims, the singular forms "a", "an", and "the" include plural referents unless the context clearly dictates otherwise.

It is to be understood that the embodiments herein disclosed are illustrative in all respects and not restrictive. The scope of the present invention is defined by the appended claims rather than by the description preceding them, and all changes that fall within the meanings and the bounds of the claims, or equivalence of such meanings and bounds are intended to be embraced by the claims.

The invention claimed is:

1. A molding device for molding a magnet roll with a profiled cross-section, comprising:

a heating and kneading unit that supplies, to a cylindrical metal mold, a kneaded material obtained by heating and kneading a raw mixture including ferromagnetic particles and thermoplastic resin;

an extrusion molding unit that molds the supplied kneaded material by the metal mold; and a magnetic field generating unit disposed at an end portion of the metal mold in a lengthwise direction that generates a magnetic field inside the metal mold, wherein the metal mold has a profiled C-shaped cross-section at an inlet for the kneaded material and a profiled C-shaped cross-section at an outlet for the kneaded material, and wherein, in the metal mold, the cross-section at the outlet for the kneaded material has more irregularities than the cross-section at the inlet for the kneaded material.

2. The molding device according to claim 1, wherein the inlet has a cross-sectional area equal to or larger than the cross-sectional area of the outlet.

3. The molding device according to claim 1, wherein the outlet of the metal mold is provided with a protruding portion that protrudes in an extrusion direction so as to encircle the outlet and a flange portion that is circumferentially provided on an outer surface of the outlet.

4. The molding device according to claim 1, further comprising:

a cooling unit that cools a molding formed of the kneaded material that has been extruded from the outlet.

5. A metal mold for extruding and molding a magnet roll, comprising:

an inlet having a profiled C-shaped cross-section;

an outlet having a profiled C-shaped cross-section; and a diminishing-diameter portion where an internal surface progressively diminishes in diameter from the inlet having the profiled C-shaped cross-section to the outlet having the profiled C-shaped cross-section, wherein the cross-section at the outlet has more irregularities than the cross-section at the inlet.

6. A molding device for molding a magnet roll with a profiled cross-section, comprising:

a heating and kneading unit that supplies, to a cylindrical metal mold, a kneaded material obtained by heating and kneading a raw mixture including ferromagnetic particles and thermoplastic resin;

an extrusion molding unit that molds the supplied kneaded material by the metal mold; and a magnetic field generating unit disposed at an end portion of the metal mold in a lengthwise direction that generates a magnetic field inside the metal mold, wherein the metal mold has a profiled C-shaped cross-section at an inlet for the kneaded material and a profiled C-shaped cross-section at an outlet for the kneaded material, and wherein, in the metal mold, a difference between distances from an adjacent depression portion and projection portion to a central axis at the outlet for the kneaded material is larger than a difference between distances from the adjacent depression portion and projection portion to the central axis at the inlet for the kneaded material.

7. The molding device according to claim 6, wherein the inlet has a cross-sectional area equal to or larger than the cross-sectional area of the outlet.

8. The molding device according to claim 6, wherein the outlet of the metal mold is provided with a protruding portion that protrudes in an extrusion direction so as to encircle the outlet and a flange portion that is circumferentially provided on an outer surface of the outlet.

9. The molding device according to claim 6, further comprising:

a cooling unit that cools a molding formed of the kneaded material that has been extruded from the outlet.

10. A metal mold for extruding and molding a magnet roll, comprising:

an inlet having a profiled C-shaped cross-section;

an outlet having a profiled C-shaped cross-section; and a diminishing-diameter portion where an internal surface progressively diminishes in diameter from the inlet having the profiled C-shaped cross-section to the outlet having the profiled C-shaped cross-section, wherein a difference between distances from an adjacent depression portion and projection portion to a central axis at the outlet is larger than a difference between distances from the adjacent depression portion and projection portion to the central axis at the inlet.

* * * * *